United States Patent [19]

Yang

[11] Patent Number: 4,515,549

[45] Date of Patent: May 7, 1985

[54] HIGH SPEED AUTOMATIC BRICK MAKING MACHINE

[76] Inventor: Der C. Yang, 298 Chung Hwa Rd., Ta Yuan, Tao Yuan, Taiwan

[21] Appl. No.: 207,919

[22] Filed: Nov. 18, 1980

[51] Int. Cl.[3] ..... B28B 3/12; B28B 5/02

[52] U.S. Cl. ..... 425/350; 425/220; 425/373; 425/441

[58] Field of Search ..... 425/373, 363, 348 R, 425/350, 351, 220, 345, 441

[56] References Cited

U.S. PATENT DOCUMENTS 1,265,138 5/1918 Taylor ..... 425/350

3,724,988 4/1973 Gouws ..... 425/348

*Primary Examiner*—Jay H. Woo

*Assistant Examiner*—James C. Housel

*Attorney, Agent, or Firm*—Tak K. Sung

[57] ABSTRACT

An automatic machine for pressing bricks at high speeds is provided with a pressure wheel and pressing tongues attached to the circumference of the wheel through an axle which permits the tongues to rotate or swing about the axle. Clay material is fed to an endless belt comprising a plurality of moulds, pressed by the pressure wheel, and then conveyed to a release station. The railing for the endless belt has an expanded portion so that the end walls of the moulds are released outwardly as they pass this portion, allowing the pressed brick to drop to another belt to be sent to an oven.

1 Claim, 5 Drawing Figures

FIG. 1
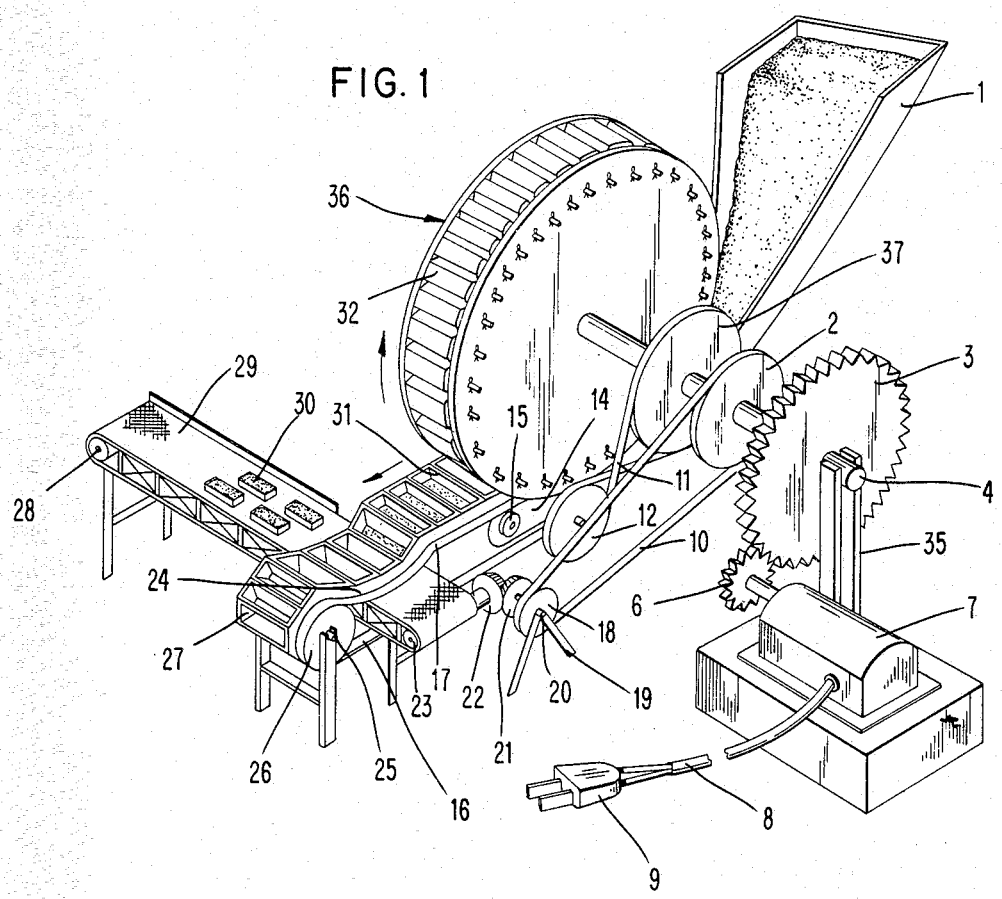
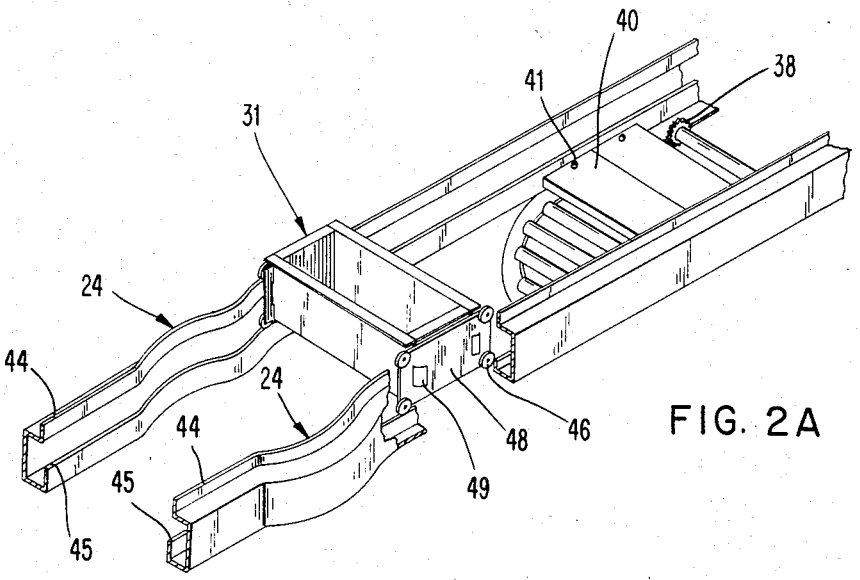
FIG. 2A

HIGH SPEED AUTOMATIC BRICK MAKING MACHINE

FIELD OF INVENTION

This invention relates to a high speed brick making machine, especially an automatic machine which has a wheel and many tongues for pressing bricks installed in their circumference. When the wheel turns, the tongues press into the moulds of brick one by one. Thereafter, through automatic mould peeling devices unburnt bricks are obtained continuously.

DESCRIPTION OF PRIOR ART

Although conventional automatic brick making machines, labor, the unburnt bricks they produce still contain 35% of moisture and are difficult, to dry. Consequently, large amounts of energy and space are needed to dry these bricks.

SUMMARY OF INVENTION

An object of this invention is to remove the abovementioned defects and to provide an improved high speed drying machine for making bricks automatically.

BRIEF DESCRIPTION OF DRAWINGS

FIG. 1 is an oblique perspective view of the present device.

FIG. 2A is an oblique perspective view of the mould conveyor and illustrates peeling of the unburnt brick from the mold.

DETAILED DESCRIPTION OF THE PREFERRED EMBODIMENT

Figure 2B:
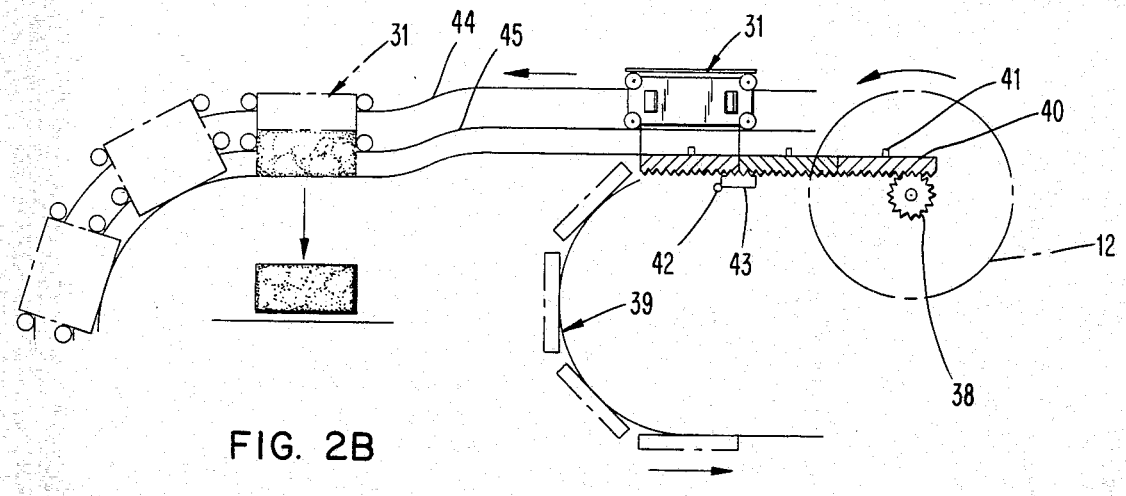
FIG. 2A is a cross-sectional view of the mould and mould conveyer.

The brick making machine is driven by a motor of 30 to 50 horsepower. The machine comprises pressure wheel (36) in the circumference of which the brick pressing tongues (32) are installed. When the pressure wheel (36) turns, tongues (32) press into the moulds (31) until the depth of, the clay in the mould is reduced by half. Thus, the clay is pressed tightly as unburnt bricks (30) one by one.

The pressure wheel (36) and gear wheel (2) (3) are fixed on the same shaft and are fixed on the supporting rack (5,35). The force exerted by pressure wheel can be adjusted by a jack installed under the platform (14). When the jack is raised, the density of the bricks in the moulds is increased and when the jack is lowered the density of bricks decreases.

The rotational speed of the pressure wheel (36) corresponds to the speed of the driving wheel (12) which is also driven by the transmission wheel (37), and it is also the sliding speed of the moulds (31). By means of the counter-driven transmitting belt (11), the rotational direction of the pressure wheel (36) is opposite to the moulds (31).

The clay is fed into the empty moulds (31) through a hopper (1). After the clay has been deposited, the mould moves forward passing under a trowel which removes the clay just above the brim of the moulds. When the mould goes under the pressure wheel, the pressing tongue (32) presses into the mould. The clay is pressed tightly to ½ its original thickness and is compacted into an unburnt brick).

Then the moulds are moved continuously by conveyer to the bent rail (24) for peeling the unburnt bricks. At this point, the spring (49) of control latch (48) on both sides of mould (31) are released outwardly, thus the unburnt bricks are loosened, dropped onto the belt (29) one by one, and thereafter sent into the oven.

Each mould is hollow and set on boards (40) and locked by the sticks (41). These boards are driven by rollers (39) which are driven by the gear (38) when the chassis power wheel (12) turns.

The board (40) slides to the wheel (15). It leaves mould (31) and continuously turns along roller (39) as showed in FIG. 2., and then both sides of the mould are released, so that the unburnt brick falls on the conveying belt (29). The empty mould will turn underneath the roller (26) through the upper and lower rails (44, 45) and goes back to the hopper to be filled again.

Figure 3A:
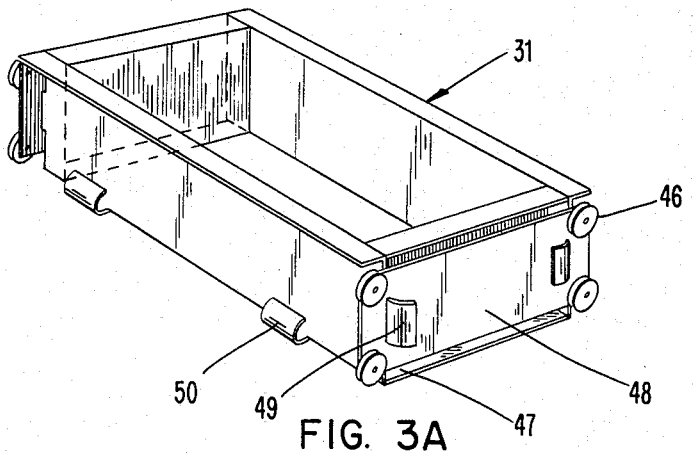
FIG. 3A illustrates the mould.

The moulds are connected to one another by connectors (50) shown in FIG. 3A and the boards are connected by board hooks (42, 43).

Figure 3B:
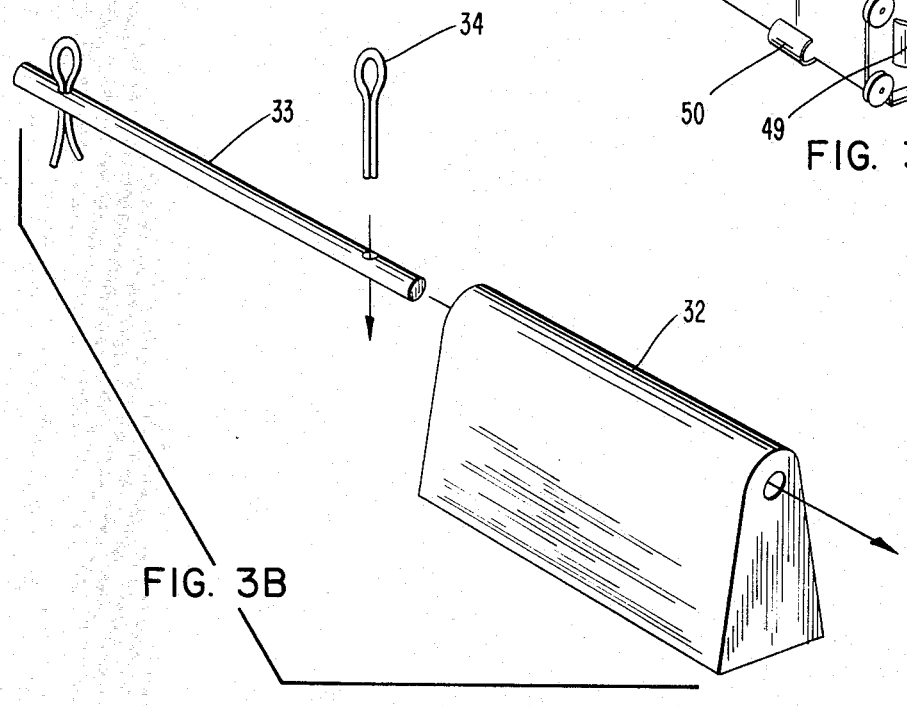
FIG. 3B illustrates the pressing tongue.

In FIG. 3B axle 33 passes through bore in press tongue 32. The ends of axle 33 are attached to the circumference of pressure wheel 36 by means of clips 34 so that each press tongue 32 is free to rotate about axle 33.

The pressure wheel for example has a weight of 150 to 200 kilograms, with a circumference of 3500 to 3600 cm. a width of 30 to 50 cm and 25 to 27 pressing tongues which are 21 cm in length, 11 cm in width and 12 cm in thickness. The pressing tongue (32) is fixed through the axle (33) on the pressure wheel by bolts and nuts (not shown) or cotter pins (34) as shown in FIG. 3.

The power transmission wheel (2) drives wheel (18) and the gear wheel (21) then drives gear (22) as shown in FIG. 1. Their ratio is such that when the power transmission wheel (2) turns one revolution, the gear (22) shall turn 35 revolutions, which is convenient for the conveyance of unburnt bricks.

With a motor of 30 to 50 Hp. and axle gear (6) of 1100 r.p.m., the power transmission wheel (3) drives the pressure wheel at a speed of 11 r.p.m. Therefore with 25 to 26 pressing tongues on its circumference as an example, we calculate the machine should produce $11 \times 26 \times 60 = 17{,}160$ pieces/hour, or more than four hundred thousand pieces of brick per day.

What is claimed is:

1. A high speed automatic brick making machine comprising:

(a) a pressure wheel having at its circumference brick pressing tongues said tongues being free to rotate and each being attached to said wheel by means of an axle passing through the tongue, the ends of the axle being fixed to the circumference of the pressure wheel;

(b) a plurality of moulds disposed on an endless belt, said moulds having a pair of side-walls and a pair of expandable end walls, said moulds corresponding to said press tongues the press tongues reducing the height of the material in the moulds by about one half, the railing for the endless belt having an expanded portion whereat the end walls expand to release the compressed brick contained within the mould after compression;

(c) a hopper for feeding clay to the moulds; and (d) driving means for said pressure wheel and endless belt.

* * * * *